US007507121B1

(12) United States Patent
Scea et al.

(10) Patent No.: US 7,507,121 B1
(45) Date of Patent: Mar. 24, 2009

(54) EMC CLAMP FOR THREE EXIT BACKSHELL

(75) Inventors: Kenneth Scea, Poughkeepsie, NY (US); Lynda L Anderson, Saugerties, NY (US); Robert L Nicoletti, Milton, NY (US); Andrew Rybak, Hopewell Junction, NY (US)

(73) Assignee: International Business Machines Corporation, Armonk, NY (US)

( * ) Notice: Subject to any disclaimer, the term of this patent is extended or adjusted under 35 U.S.C. 154(b) by 0 days.

(21) Appl. No.: 12/193,962

(22) Filed: Aug. 19, 2008

Related U.S. Application Data

(63) Continuation of application No. 12/108,058, filed on Apr. 23, 2008, now Pat. No. 7,438,597.

(51) Int. Cl.
*H01R 9/03* (2006.01)

(52) U.S. Cl. ..... 439/610; 439/942

(58) Field of Classification Search ..... 439/98, 439/460, 465, 487, 578, 585, 610, 906, 942
See application file for complete search history.

(56) References Cited

U.S. PATENT DOCUMENTS

| | | | | |
|---|---|---|---|---|
| 5,281,762 | A * | 1/1994 | Long et al. | 174/78 |
| 5,788,534 | A * | 8/1998 | Koegel et al. | 439/465 |
| 5,820,412 | A * | 10/1998 | Koegel et al. | 439/610 |
| 5,831,815 | A | 11/1998 | Miller et al. | |
| 6,595,789 | B2 * | 7/2003 | Oota et al. | 439/98 |
| 7,438,597 | B1 * | 10/2008 | Scea et al. | 439/610 |

* cited by examiner

*Primary Examiner*—Thanh-Tam T Le
(74) *Attorney, Agent, or Firm*—The Law Firm of Andrea Hence Evans, LLC

(57) ABSTRACT

An electromagnetic compatibility (EMC) clamp for an electrical connector which allows in one embodiment the reduction of a 12× cabling system to four 3× cabling system. The construction of another embodiment is compatible with the Infiniband technology especially when using Octopus cables. One embodiment of the clamp is in compliance with FCC Class B requirements.

1 Claim, 3 Drawing Sheets

EMC CLAMP FOR THREE EXIT BACKSHELL

CROSS REFERENCE TO RELATED APPLICATIONS

The present application is a continuation of prior U.S. application Ser. No. 12/108,058, filed Apr. 23, 2008, the entirety of which is incorporated herein by reference.

FIELD OF THE INVENTION

This invention relates to Electromagnetic Compatibility (EMC) clamps. Specifically, it relates to clamps used to reduce larger bulk cabling into smaller bulk feed and/or exit cabling.

BACKGROUND OF THE INVENTION

Implementation of Infiniband technology (IB) requires many varied technologies. One of these technologies is a variety of 12× to 4× cabling solutions also known as Octopus cables. One problem with these cabling solutions is with the gauge of the wire required in the application to meet IB specifications and distance requirements. Bulk cable used in these IB applications must meet stringent guidelines with respect to signal attenuation. Larger gauge wires result in less space to use in the connectors and the connector cannot be assembled.

SUMMARY OF THE INVENTION

It is an aspect of an embodiment of the present invention to provide a modified plural exit clamp for use with a multiple wire style connector.

It is another aspect of an embodiment of the present invention to provide a clamp that provides a complete EMC seal for a cable in accordance with FCC Class B requirements.

DETAILED DESCRIPTION OF THE INVENTION

Figure 1:
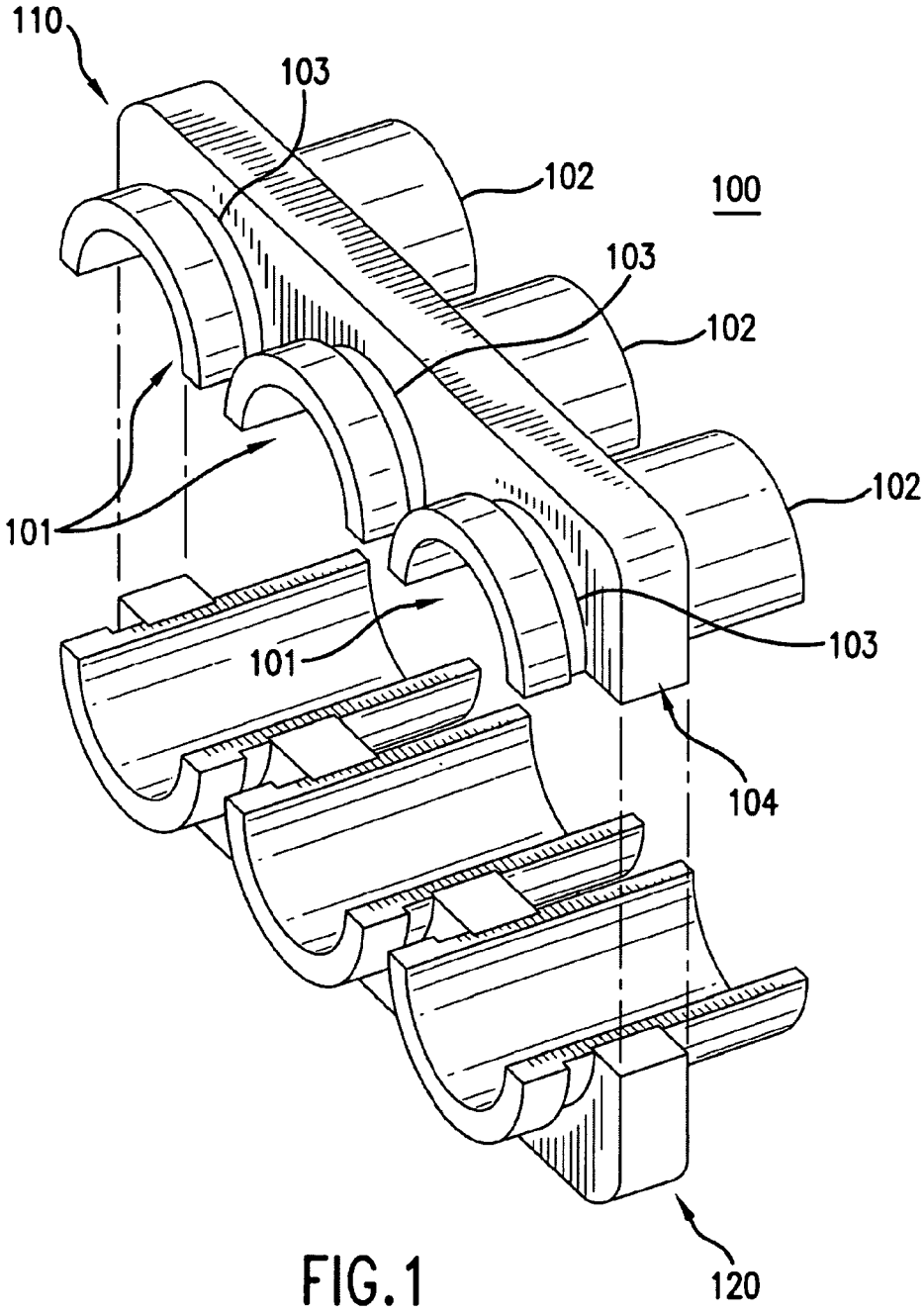
FIG. 1 is a view of an embodiment of the present invention.
Figure 2:
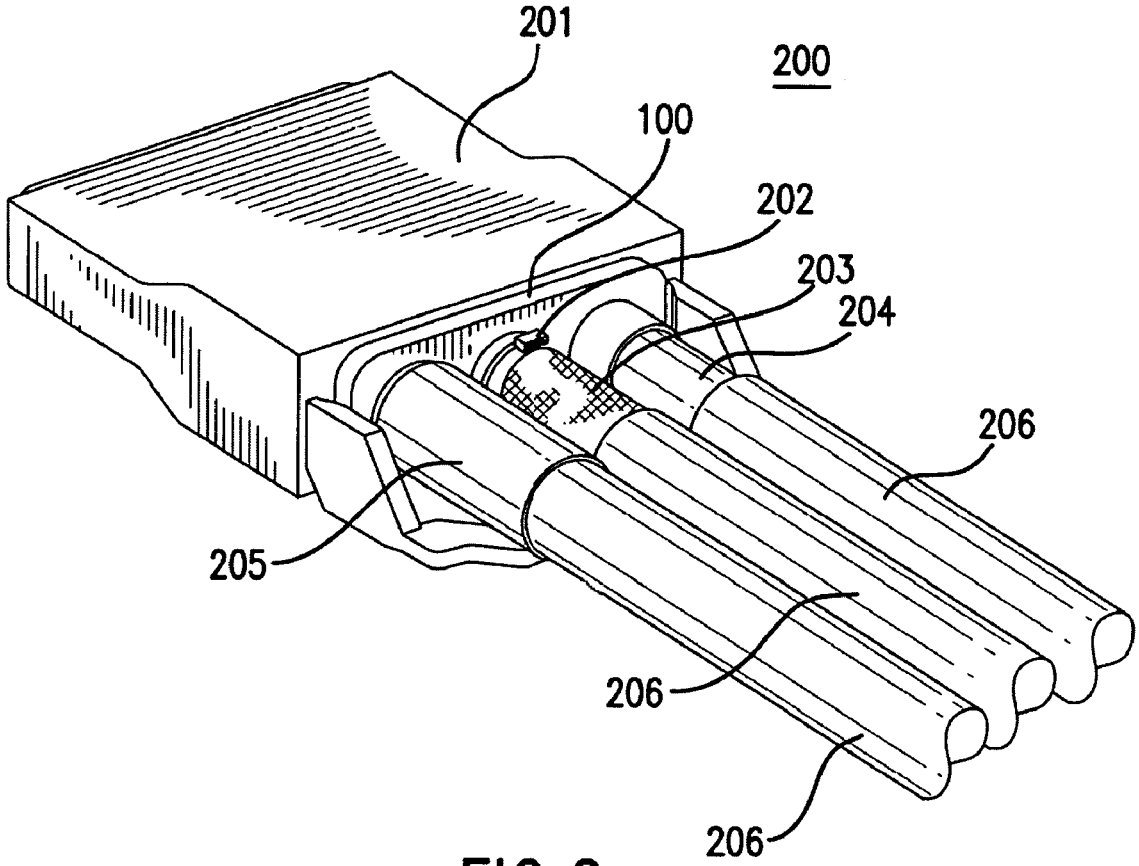
FIG. 2 is an exemplary detailed view of an embodiment of the attachment of the present invention to a cabling system.

FIG. 1 illustrates an embodiment of according to one aspect of the present invention. The cable adapter or clamp 100 may include a plurality of openings 101 which may be located inside a backshell housing 201 shown in FIG. 2 and the adapter 100 has openings 102 located outside the backshell housing 201. The openings 101 and 102 correspond to openings (not shown) in the backshell housing 201 through which cables 206 in FIG. 2 are installed. Clamp 100 may include depressed grooves 103 for attachment to the inside of the backshell housing 201. According to an embodiment of the present invention, clamp 100 is metallic. Any metal may be used that can provide compliance with FCC Class B requirements. These metals include, but are not limited to, copper, nickel, aluminum and combinations and alloys thereof. Bridge part 104 is located at the interface between openings 101 and 102. It is noted that the clamp 100 contains at least two separate parts. The embodiment of FIG. 1 may include separate top part 110 and a separate bottom part 120. The separate bottom part 120 may be a mirror image of the separate top part 110. It is noted that the present invention is not limited to the embodiment disclosed in FIG. 1. While FIG. 1 is shown to have three openings 101 or 102, it is noted that this embodiment may include any cable or wire connector application which requires EMC shielding. This embodiment may include 2 or 4 cable applications which require noise isolation for high frequency/data rate systems. Those of ordinary skill in the art will realize the present invention may be modified without departing from the scope or spirit of the invention.

FIG. 2 illustrates an exemplary detailed view 200 of an embodiment of the present invention with the adapter or clamp 100 attached to the backshell housing 201. Element 200 may be an electrical connector. Embodiment 200 may include a cable bodies 206 overwrapped with shrink tubing 205. The wires 204 are attached to the adapter or clamp 100. Shield 203 may be installed over the clamp 100. The shield 203 may be braided. Clamp strap 202 may be used to secure the top part of clamp 110 to the bottom part of clamp 120 and to the backshell housing 201. Clamp strap 202 may be a metallic crimp ring. Any metal may be used for clamp strap 202 as known to those skilled in the art. To assemble the clamp 100 to the backshell housing 201 according to an embodiment of the present invention, bulk wires 204 are prepared by removing the bulk jackets 206 and pulling back the shield 203. Further assembly may include attaching the at least one separate top part of the metallic clamp 110 in the backshell housing 201 and over the at least one cable 206 installed therein and attaching the at least one separate bottom part of the metallic clamp 100 in the backshell housing 201 and under the at least one cable 206 installed therein and attaching the at least one cable 206 installed, the at least one separate top part of the metallic clamp 100 and the at least one separate bottom part of the metallic clamp 100 using at least one metallic crimp ring 202. While FIG. 2 is shown to have three openings in clamp 100, it is noted that this embodiment may include any cable or wire connector application which requires EMC shielding. This embodiment may include 2 or 4 cable applications which require noise isolation for high frequency/data rate systems. Those of ordinary skill in the art will realize the present invention may be modified without departing from the scope or spirit of the invention.

Figure 3:
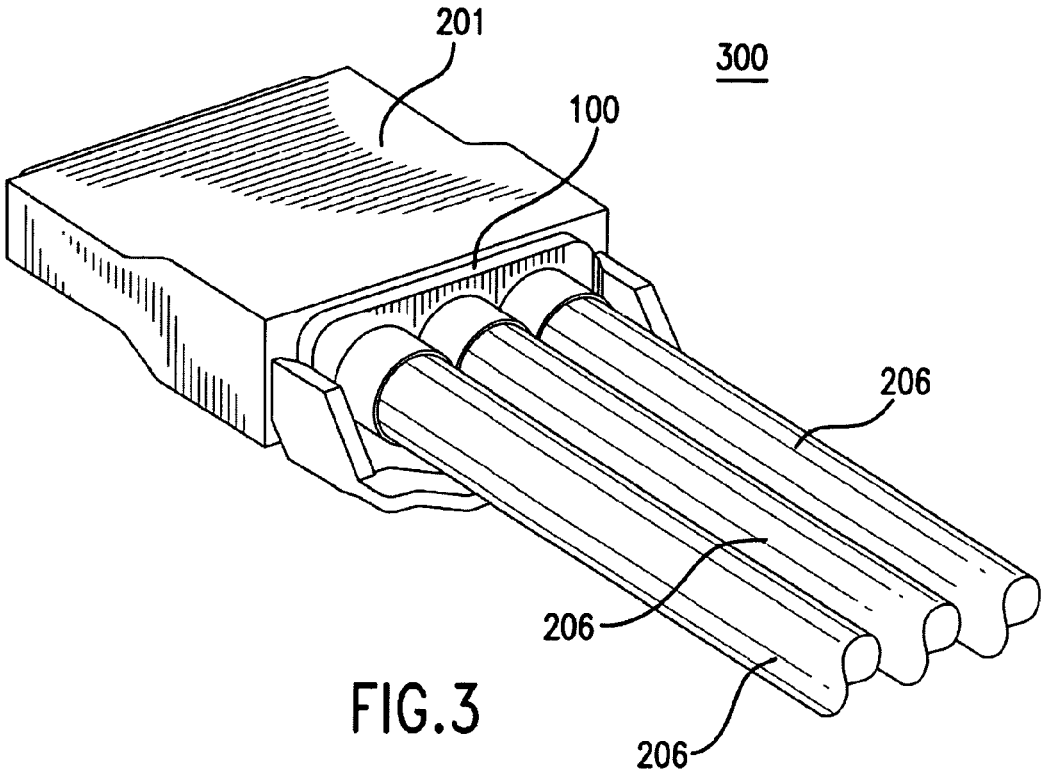
FIG. 3 is general view of an embodiment of the present invention used with a cabling system.

FIG. 3 illustrates a general view of an embodiment of the present invention. Assembled connector 300 shows backshell housing 201 with clamp 100 installed. Embodiment 300 may include at least one cable 206 connected to adapter or clamp 100 and backshell housing 201. While FIG. 3 is shown to have three openings in clamp 100, it is noted that this embodiment may include any cable or wire connector application which requires EMC shielding. This embodiment may include 2 or 4 cable applications which require noise isolation for high frequency/data rate systems. Those of ordinary skill in the art will realize the present invention may be modified without departing from the scope or spirit of the invention.

The invention has been described in detail with particular reference to certain preferred embodiments thereof, but it will be understood that variations and modifications can be effected within the spirit and scope of the invention.

The invention claimed is:

1. A metallic clamp assembly for attachment to a backshell of an electrical connector comprising:

a backshell housing including a plurality of backshell housing openings having at least one cable installed therein;

a metallic clamp with at least one separate top part and at least one separate mirror imaged bottom part, the metallic clamp further comprising at least one first clamp opening and an opposite second clamp opening extending from opposite sides of a bridge part respectively;

wherein the at least one separate top part of the metallic clamp is attached in the backshell housing and over the at least one cable installed therein and the at least one separate bottom part of the metallic clamp is attached in the backshell housing and under the at least one cable installed therein;

wherein the at least one cable installed, the at least one separate top part of the metallic clamp and the at least one separate bottom part of the metallic clamp are attached using at least one metallic crimp ring.

* * * * *